US006739065B2

(12) United States Patent
Hofmeister et al.

(10) Patent No.: US 6,739,065 B2
(45) Date of Patent: May 25, 2004

(54) PICTURE HANGING DEVICE

(75) Inventors: Eric R. Hofmeister, Sagamore Hills, OH (US); Daniel R. Karon, 3357 Ardmore Rd., Shaker Heights, OH (US) 44120

(73) Assignee: Daniel R. Karon, Shaker Heights, OH (US)

( * ) Notice: Subject to any disclaimer, the term of this patent is extended or adjusted under 35 U.S.C. 154(b) by 0 days.

(21) Appl. No.: 10/219,992

(22) Filed: Aug. 15, 2002

(65) Prior Publication Data

US 2003/0051363 A1 Mar. 20, 2003

Related U.S. Application Data

(60) Provisional application No. 60/313,335, filed on Aug. 20, 2001.

(51) Int. Cl.[7] ..... G01B 3/02

(52) U.S. Cl. ..... 33/613; 33/666; 33/577; 33/451; 33/679.1

(58) Field of Search ..... 33/613, 666, 483, 33/484, 485, 489, 493, 494, 495, 574, 577, 451, 427, 464, 679.1, 486

(56) References Cited

U.S. PATENT DOCUMENTS

| | | | | | |
|---|---|---|---|---|---|
| 3,371,423 | A | * | 3/1968 | Paul | 33/666 |
| 3,516,165 | A | | 6/1970 | Pfeffer | |
| 4,220,309 | A | | 9/1980 | Eisen et al. | |
| 4,241,510 | A | | 12/1980 | Radecki | |
| 4,382,337 | A | | 5/1983 | Bendick | |
| 4,455,756 | A | | 6/1984 | Greene | |
| 4,473,957 | A | | 10/1984 | Faulkner | |
| 4,485,561 | A | * | 12/1984 | Hopkins, Sr. | 33/574 |
| 4,512,084 | A | * | 4/1985 | Lieberman | 33/574 |
| 4,517,860 | A | | 5/1985 | Dameron, Jr. | |
| 4,559,690 | A | | 12/1985 | Asmus | |
| 4,893,776 | A | | 1/1990 | Floyd | |
| 5,103,573 | A | * | 4/1992 | Ehling et al. | 33/613 |
| 5,109,611 | A | | 5/1992 | Houck | |
| 5,129,154 | A | | 7/1992 | Aydelott | |
| 5,180,135 | A | | 1/1993 | Hindall | |
| 5,361,510 | A | * | 11/1994 | Cox | 33/613 |
| 5,471,760 | A | | 12/1995 | Farris | |
| 5,509,213 | A | | 4/1996 | Kelly et al. | |
| 5,520,318 | A | | 5/1996 | Sloop | |
| 5,634,279 | A | | 6/1997 | Ariyo | |
| 5,867,917 | A | | 2/1999 | Karon | |
| 6,000,142 | A | | 12/1999 | Deaton | |

(List continued on next page.)

*Primary Examiner*—Diego Gutierrez
*Assistant Examiner*—Madeline Gonzalez
(74) *Attorney, Agent, or Firm*—Rankin, Hill, Porter & Clark LLP

(57) ABSTRACT

The present invention relates to a device for use in marking a point on a wall where a fastener should be installed in order to hang an object at a desired location on the wall. A device according to the invention includes an elongate frame having an elongate slot. The frame is adapted to be positioned adjacent to a back surface of the object to be hung. The device further includes a ledge projecting from the frame. The ledge is adapted to be positioned in contact with a top surface of the object. The device also includes a carriage that is supported by the frame. The carriage is adapted for reciprocating movement along the slot. The device further includes a pin that is carried by the carriage. The pin terminates on a first end in a stylus that extends in a direction away from the back surface of the object when the frame is positioned adjacent thereto. The device also includes a plurality of hooks that are carried by the carriage. The hooks are disposed at predetermined distances below the stylus. Finally, the device includes means for temporarily holding the carriage in a fixed position relative to the frame. In the preferred embodiment, the means for temporarily holding the carriage in a fixed position relative to the frame comprises a knob that holds a threaded bolt that extends through said elongate slot and engages a nut on an opposite side of said carriage.

18 Claims, 7 Drawing Sheets

U.S. PATENT DOCUMENTS 6,003,825 A 12/1999 Abernathy, Jr.
6,029,362 A 2/2000 Miodragovic
6,032,378 A * 3/2000 Null ..... 33/613
6,049,991 A 4/2000 Gruenberg et al.
6,185,831 B1 * 2/2001 Pluciennik ..... 33/613
6,473,983 B1 * 11/2002 Gier ..... 33/613

* cited by examiner

SECTION A-A

PICTURE HANGING DEVICE

This application claims benefit of non provisional of 60/313,335 filed on Aug. 20, 2001.

FIELD OF INVENTION

This invention relates to a device for use in marking a point on a wall where a fastener should be installed in order to hang an object at a desired location on the wall.

BACKGROUND OF THE INVENTION

The process of hanging a picture on a wall can be very frustrating. Most pictures are hung by a cord or wire that is strung across a back surface of the picture. The cord or wire hangs over a nail or other fastener anchored in the wall Because the exact position of the cord or wire cannot be seen while the picture is held in place against the wall, it is very difficult to determine the exact location on the wall where the nail or other fastener should be anchored in order to hang the picture at the desired location on the wall. Thus, locating the nail or other fastener in the correct position on the wall often requires repeated efforts, resulting in several holes being made in the wall.

Due to these and other difficulties, the prior art is replete with devices that are intended to assist in locating of pictures on walls. Representative examples of such prior art devices include those described in: Pfeffer, U.S. Pat. No. 3,516,165; Eisen et al., U.S. Pat. No. 4,220,309; Radecki, U.S. Pat. No. 4,241,510; Bendick, U.S. Pat. No. 4,382,337; Greene, U.S. Pat. No. 4,455,756; Faulkner, U.S. Pat. No. 4,473,957; Dameron, U.S. Pat. No. 4,517,860; Asmus, U.S. Pat. No. 4,559,690; Floyd, U.S. Pat. No. 4,893,776; Houck, U.S. Pat. No. 5,109,611; Aydelott, U.S. Pat. No. 5,129,154; Hindall, U.S. Pat. No. 5,180,135; Farris, U.S. Pat. No. 5,471,760; Kelly et al., U.S. Pat. No. 5,509,213; Sloop, U.S. Pat. No. 5,520,318; Karon, U.S. Pat. No. 5,867,917; Deaton, U.S. Pat. No. 6,000,142; and Gruenberg et al., U.S. Pat. No. 6,049,991.

Although there are many prior art devices for locating pictures on walls, there is substantial room for improvement. It will be appreciated that most prior art devices can only be used with one type of fastener. In other words, such devices are not adaptable for use with different types and sizes of fasteners. Additionally, some of the prior art devices do not take into account the stretching of a rear-mounted cord or wire when the picture is hung. Another limitation in some prior art devices is the inability to locate the position of two hangers, which are sometimes necessary to hang large objects. Finally, many of the prior art devices cannot be adapted to locate the position on a wall where a fastener should be attached in order to hang the object from a toothed metal hanger, rather than a cord or wire. A device is needed that can overcome the limitations of the prior art.

SUMMARY OF THE INVENTION

The present invention provides a device for use in marking a point on a wall where a fastener should be installed in order to hang an object at a desired location on the wall. A device according to the invention comprises: an elongate frame having an elongate slot, the frame adapted to be positioned adjacent to a back surface of the object; a ledge projecting from the frame, the ledge adapted to be positioned in contact with a top surface of the object; a carriage supported by the frame adapted for reciprocating movement along the slot; a pin carried by the carriage, the pin terminating on a first end in a stylus that extends in a direction away from the back surface of the object when the frame is positioned adjacent thereto; a plurality of hooks carried by the carriage, the hooks being disposed at predetermined distances below the pin; and means for temporarily holding the carriage in a fixed position relative to the frame. In the preferred embodiment, the means for temporarily holding the carriage in a fixed position relative to the frame comprises a knob that holds a threaded bolt that extends through said elongate slot and engages a nut on an opposite side of said carriage.

In use, the elongate frame is positioned against the back surface of the object to be hung and the ledge is positioned in contact with the top surface of the object. Preferably, the elongate frame further comprises a peak or groove for aligning the longitudinal axis of the slot with the midpoint of the top surface of the object. If the object has a hanging cord or wire, the cord or wire is placed over the pin or the appropriate hook for the particular fastener being used, and the carriage is moved along the elongate slot toward the ledge until there is tension on the cord or wire. The threaded knob or other means is then used to temporarily hold the carriage in a fixed position relative to the frame. Placement of the object against a wall causes the stylus to mark the exact location on the wall where the fastener should be anchored in order hang the object where desired.

The device according to the present invention can be used to apply tension to the hanging cord in order to mark the exact location for desired placement. The carriage carries a plurality hooks that can be used to support the hanging cord depending upon the particular fastener being used. The plurality of hooks are located at different predetermined distances below the pin. This allows the user to correctly mark the wall where the fastener should be anchored, even when fasteners of different sizes and types are used. For large picture objects, more than one device according to the present invention may be used. The device is small enough that two will easily fit across the top surface of the object Tensioning the hanging cord with two devices will correctly simulate how the object will hang from fasteners, which can be of different types.

The device according to the present invention can also be used to mark a point on a wall where a fastener should be installed in order to hang an object at a desired location using a toothed metal hanger or other similar support structure instead of a hanging cord. Once the device is centered on the top surface of the objection and located adjacent to the rear of the object, the carriage is moved along the elongate slot until a portion of a second end of the pin that passes through the carriage and extends in a direction toward the back surface of the object fits into the desired "V" of the toothed metal hanger or location on the other similar support structure. The carriage can then be locked in place using the knob or other means. Placement of the object against a wall causes the stylus to mark the exact location on the wall where the fastener should be anchored in order hang the object where desired.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION

Figure 1:
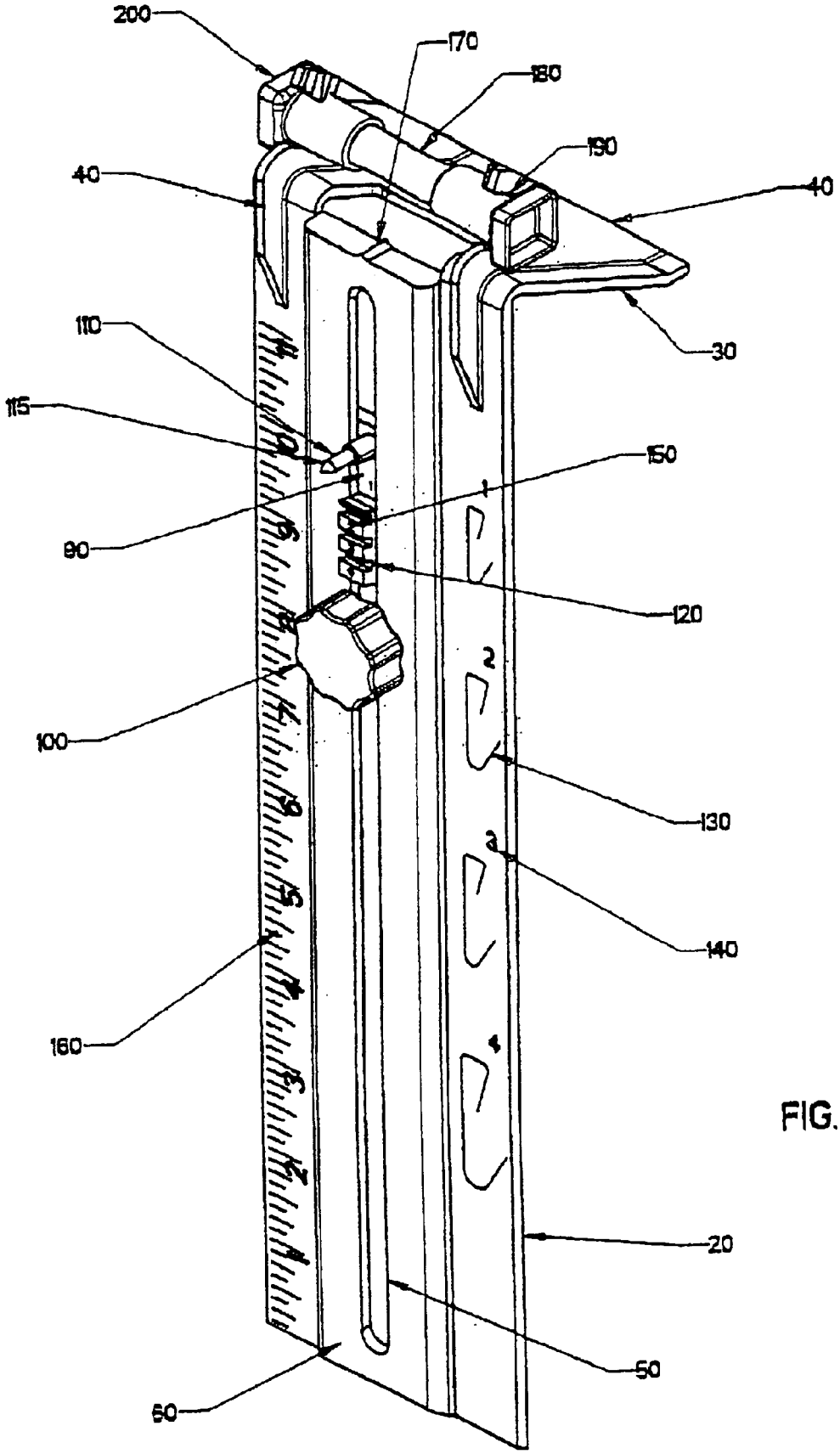
FIG. 1 is a front perspective view of one preferred embodiment of a device according to the invention.
Figure 2:
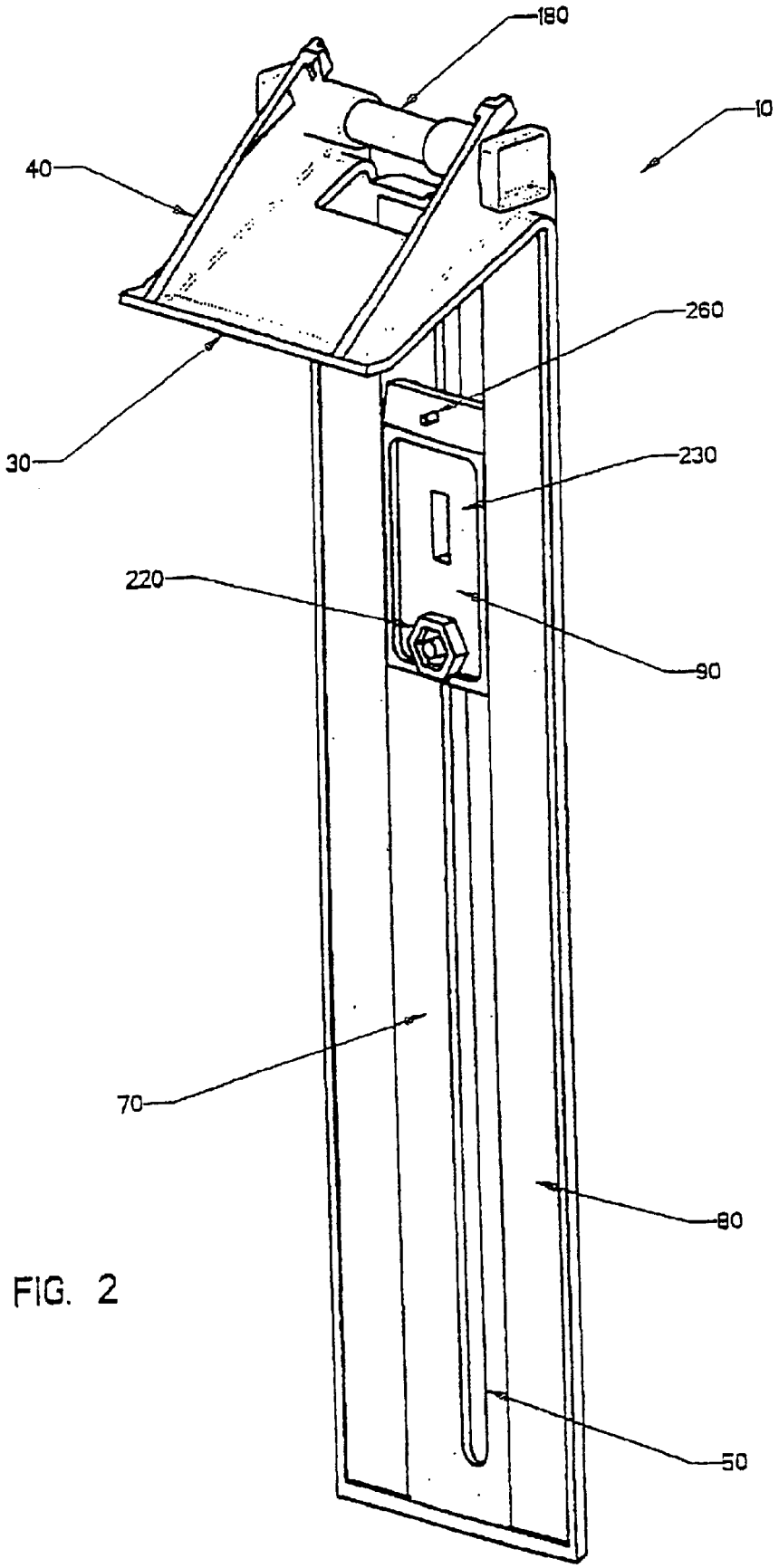
FIG. 2 is a rear perspective view of the device shown in FIG. 1.
Figure 4:
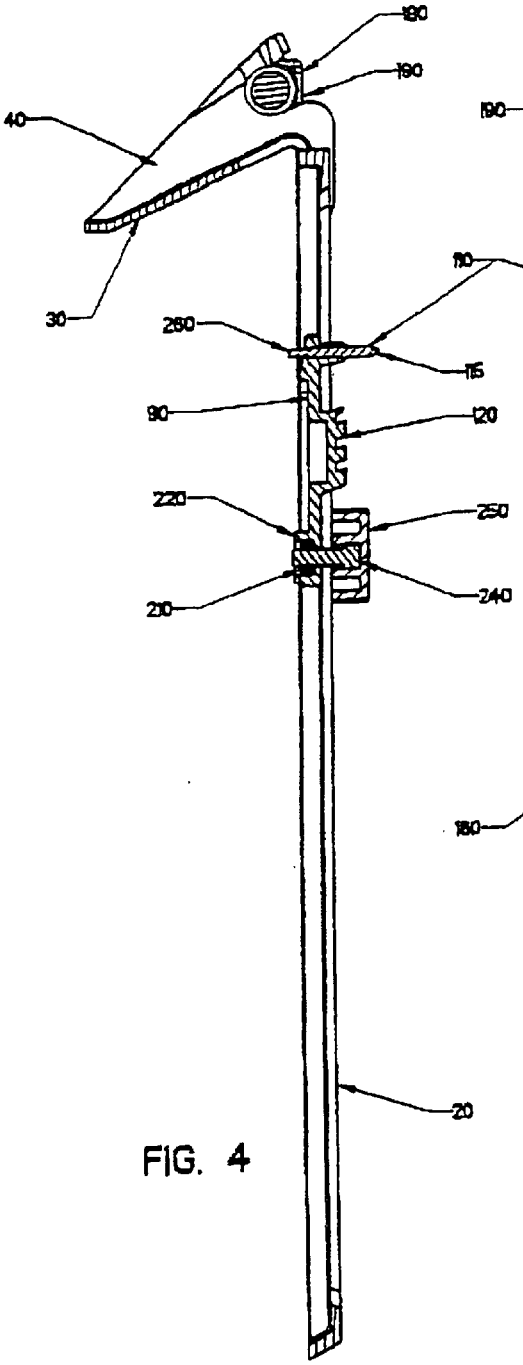
FIG. 4 is a side sectional view taken along the line A—A of the device shown in FIG. 3.
Figure 3:
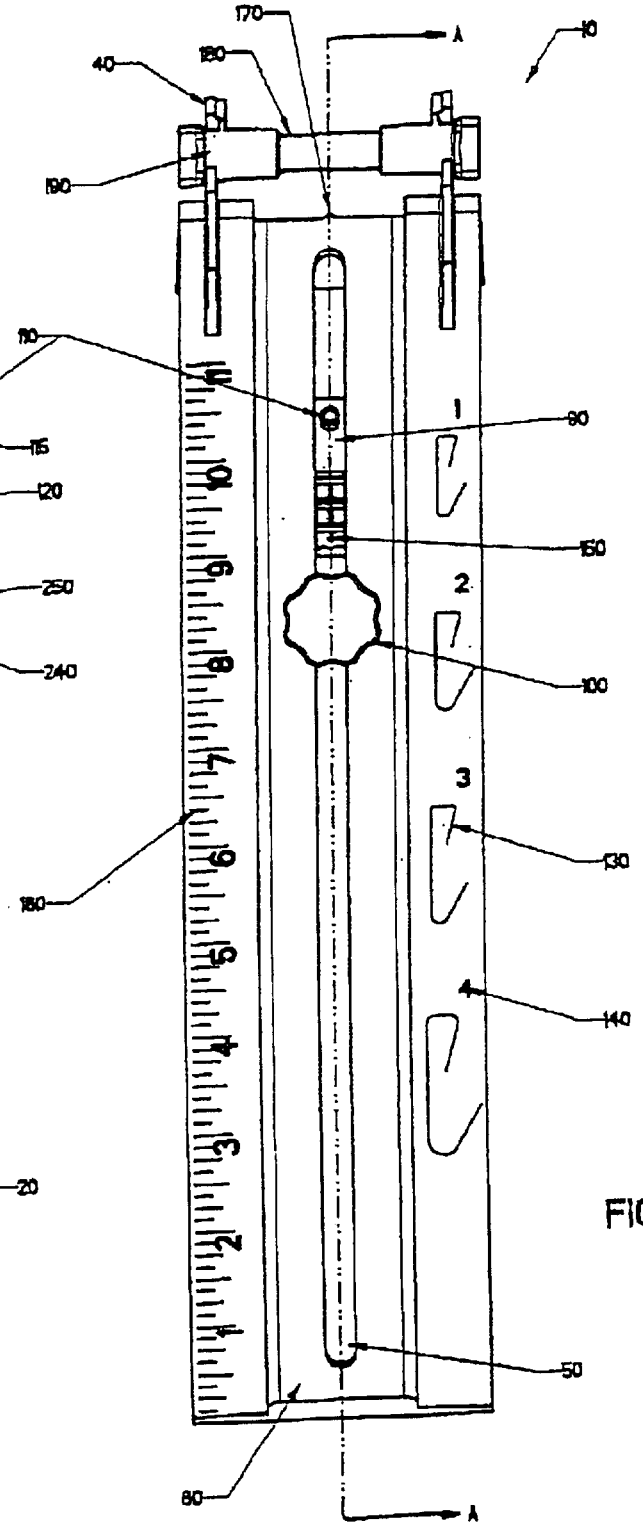
FIG. 3 is a front view of the device shown in FIG. 1.
Figure 5:
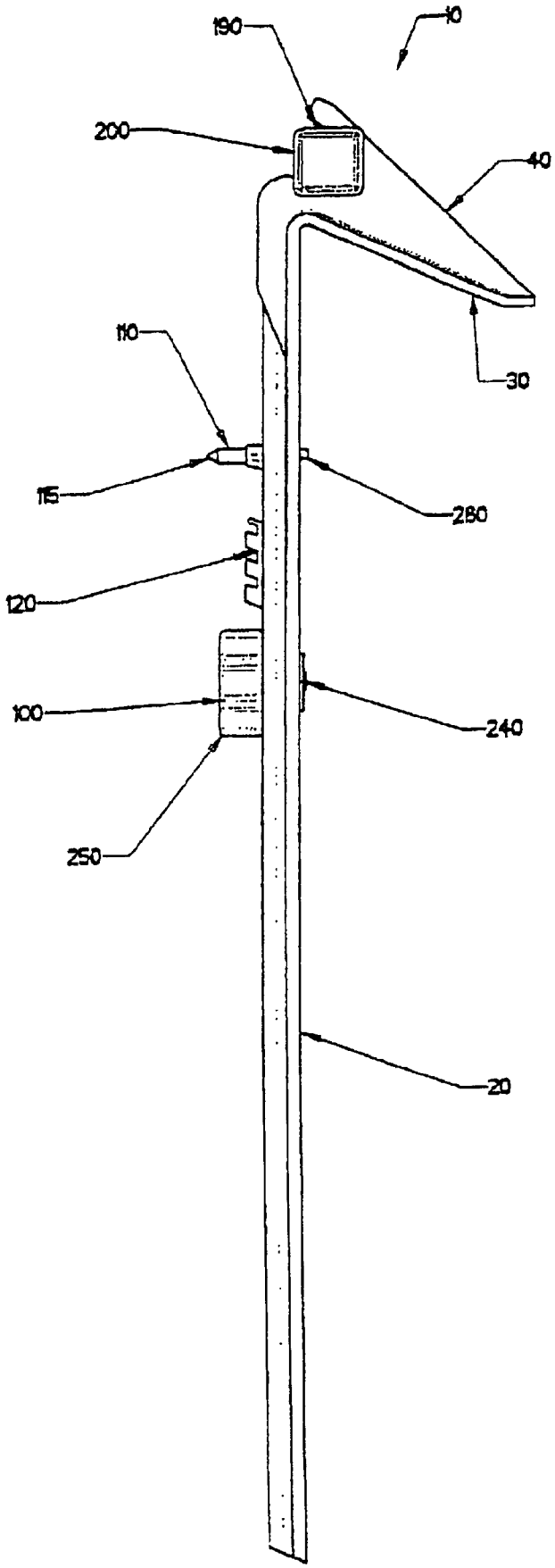
FIG. 5 is a side view of the device shown in FIG. 1.

The present invention is directed to a device 10 for use in marking a point on a wall where a fastener should be installed in order to hang an object at a desired location on the wall. With reference to FIGS. 1–5, which show various views of a preferred embodiment of a device 10 according to the invention, a device 10 comprises an elongate frame 20 having an elongate slot 50. The elongate frame 20 is adapted to be positioned adjacent to a back surface of the object to be hung on the wall. A ledge 30 projects from the elongate frame 20. The ledge 30 is adapted to be positioned in contact with a top surface of the object to be hung on the wall. It is preferable that the angle between the ledge 30 and the elongate frame 20 be 90° or less in order to maximize the amount of contact between the elongate frame 20 and the back of the object to be hung on the wall and between the ledge 30 and the top surface of the object to be hung on the wall. In the preferred embodiment, the angle is about 75°.

The elongate frame 20 and ledge 30 are preferably integrally formed of a polymeric material. In a preferred embodiment of the invention, the elongate frame 20 and ledge 30 are formed of acrylonitrile-butadiene-styrene (ABS) by injection molding, which is well known. One or more reinforcing ribs 40 can be formed at the juncture of the elongate frame 20 and ledge 30 to provide additional structural strength to the device 10.

The device 10 further comprises a carriage 90 that supported by the elongate frame 20. The carriage 90 is adapted for reciprocating movement along the slot 50. In a preferred embodiment of the invention, a channel 70 is formed on a rear surface 80 of the elongate frame 20. The carriage 90 resides in the channel 70, which defines the reciprocating movement of the carriage 90 along the entire length of the slot 50.

Preferably, the carriage 90 is made of a polymeric material such as, for example, acetal, which is also known as polyacetal, polyoxymethylene (POM), or polyformaldehyde. Acetal's high strength, modulus, and resistance to impact and fatigue, as well as its ability to slide along an elongate frame 20 formed of ABS with little friction or wear, make it a preferred material for use in forming the carriage 90.

The device 10 further comprises a pin 110 that is carried by the carriage 90. The pin 110 terminates on a first end in a stylus 115 that extends in a direction away from the back surface of the object to be hung on the wall when the elongate frame 20 is positioned adjacent thereto. The pin 110 is preferably made of aluminum to withstand wear, but it may also be made of polymeric materials, other metals, ceramics, or can be molded as one piece with the carriage 90.

The stylus 115 is used to mark the point on the wall where a fastener should be installed in order to hang an object at a desired location on the wall. In one embodiment of the invention, the stylus 115 is formed from a rigid material that can be lightly pushed into the material of the wall to create an indentation for marking the location for the fastener. In another embodiment of the invention, the stylus 115 comprises a transfer marking device such as a ink pen, marker, or pencil.

The pin 110 is preferably centered on the carriage 90 such that the stylus 115 protrudes through the slot 50, bisecting the longitudinal axis of the slot 50. The longitudinal axis of the slot 50 is the same as the section line A—A in FIG. 3. It is important that the stylus 115 protrudes through the slot 50 a distance sufficient that it is the first part of the device 10 that makes contact with the wall in use. Preferably, the elongate frame 20 further includes at least one peak 170 or groove for locating the longitudinal axis of the elongate slot 50. The peak 170 or groove assists in aligning the longitudinal axis of the slot 50 with the midpoint of the top surface of the object to be hung.

Figure 8:
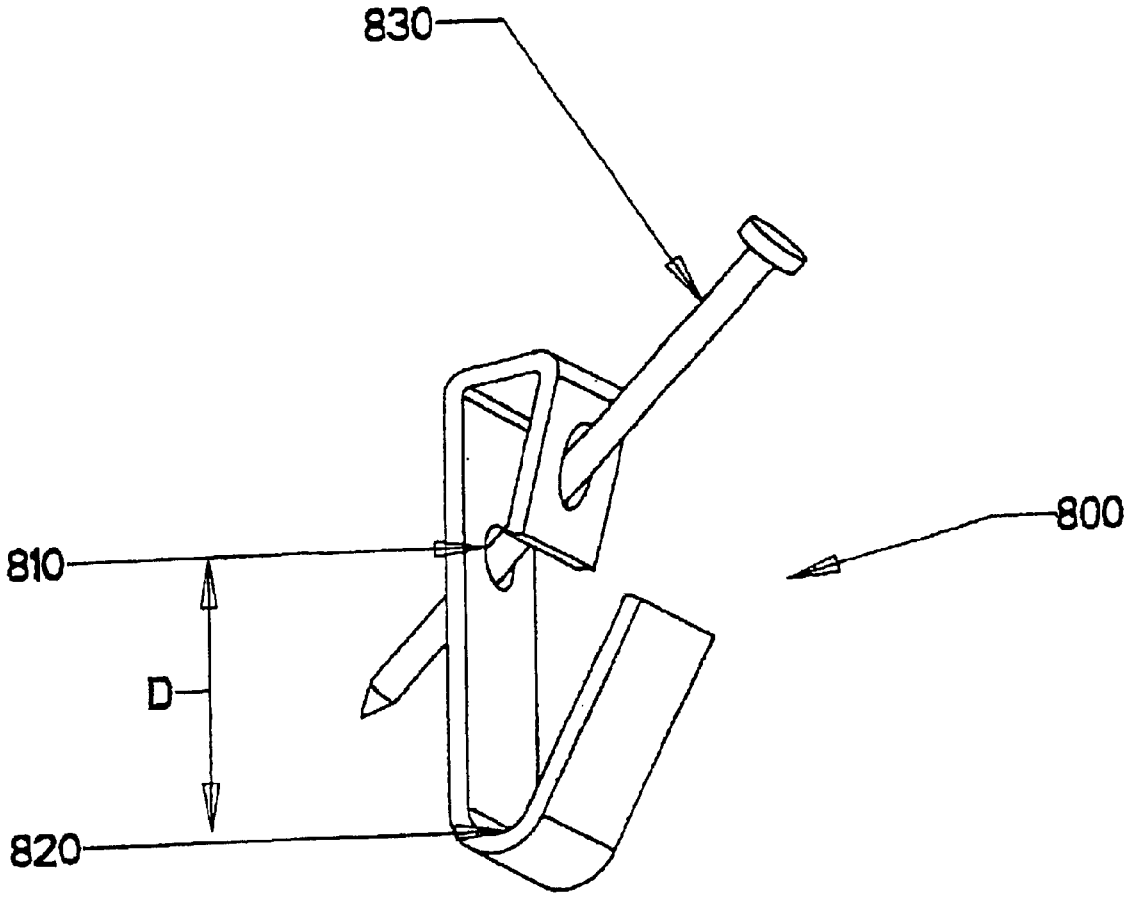
FIG. 8 is a perspective view of a type of fastener used to hang objects on walls.

The carriage 90 also carries a plurality of hooks 120. The hooks 120 are disposed at predetermined distances below the pin 110 (i.e., in a direction away from the ledge 30). The hooks 120 also protrude through the slot 50, but not to the extent of the stylus 115. It is important that the hooks 120 protrude through the slot 50 enough that a hanging wire of an object to be hung from a wall can be securely hung from one of the hooks 120. The hooks 120 hold the hanging wire attached to an object to be hung on a wall a predetermined distance below the pin 110. With reference to FIG. 8, which shows a common a type of fastener 800 used to hang objects on walls, the predetermined distance corresponds to the distance D between a first point 810 where a nail 830 enters the wall and a second point 820 where the hanging wire makes contact with the hook portion of the fastener 800.

In a preferred embodiment of the invention, indicia is disposed on the elongate frame 20 for assisting a user in determining the proper hook 120 from which to hang the hanging wire of the object. In one embodiment, the indicia comprises a plurality of silhouettes 130 of picture hanger fasteners of different sizes. The silhouettes 130 serve as guides for determining the proper hook 120 from which to hang the hanging wire of the object to be hung. Preferably, each silhouette 130 is identified by a number 140 that corresponds to a similar number 150 on a particular hook 120.

Figure 6:
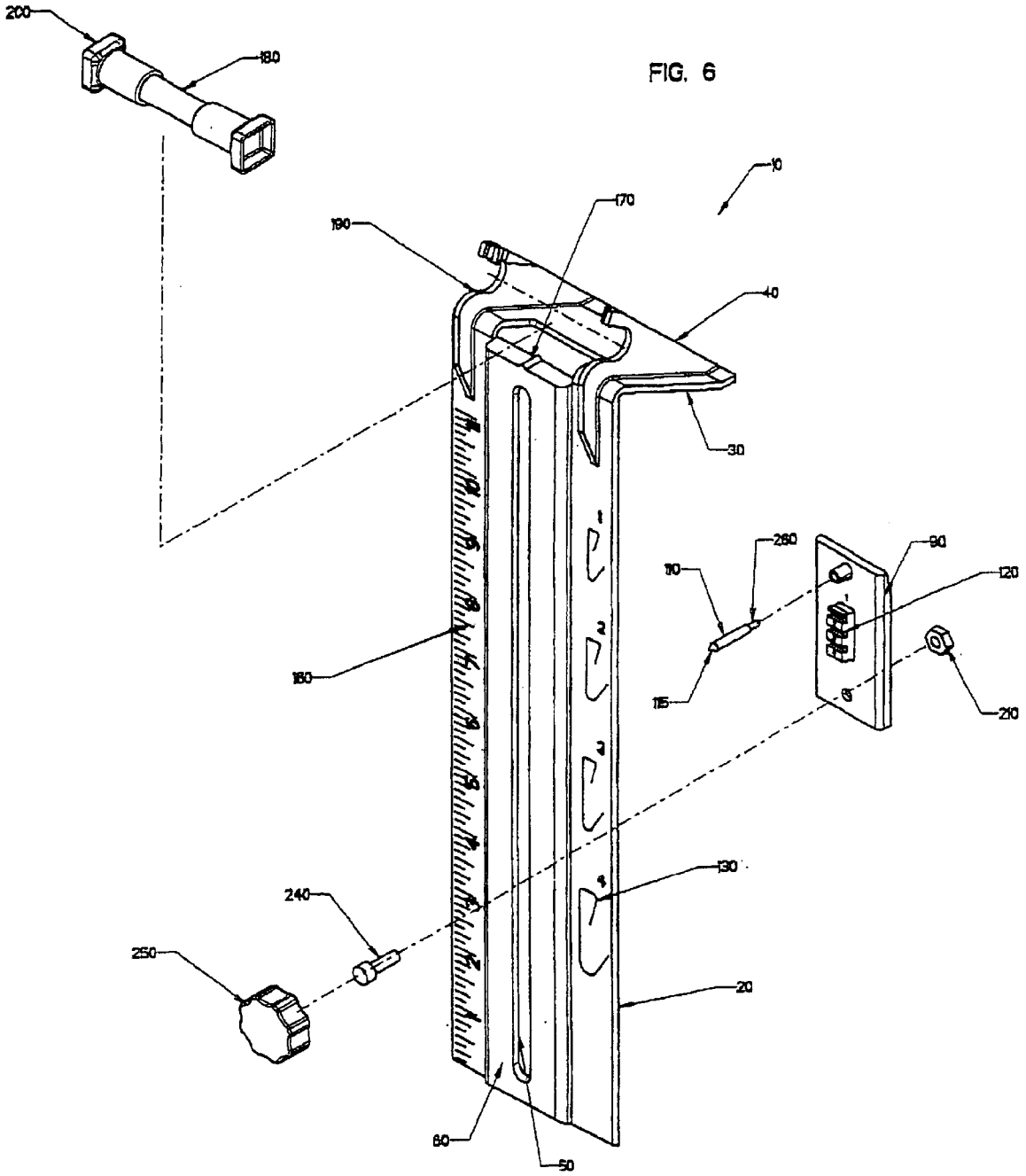
FIG. 6 is a front exploded perspective view of the device shown in FIG. 1.

The device 10 according to the invention also comprises means for temporarily holding the carriage 90 in a fixed position relative to the frame 20. With reference to FIG. 6, in the preferred embodiment of the invention, the means for temporarily holding the carriage 90 in a fixed position relative to the frame 20 comprises a knob 100 that holds a threaded bolt 240 that extends through the elongate slot 50 and engages a nut 210 on the opposite side of the carriage 90. The knob 100 is of sufficient size that it makes contact with the elongate frame 20 on either side of the slot 50. Thus, when the knob 100 is rotated clockwise, the threads draw it toward the carriage 90, which clamps the carriage against the elongate frame 20. The knob 100 also acts as a handle that a user of the device 10 can use to grip to assist in sliding the carriage 90 along the slot 50.

It will be appreciated that there are a number of alternative configurations for the means for temporarily holding the carriage 90 in a fixed position relative to the frame 20 that will suffice. For example, the knob 100 could be threaded and could engage a threaded post extending through the slot 50 from the carriage 90. Alternatively, the means for temporarily holding the carriage 90 in a fixed position relative to the frame 20 could comprise a quick-release lever that draws the carriage 90 against the elongate frame 20 when it is depressed. Essentially, any configuration that temporarily holds the carriage 90 in fixed relationship with respect to the elongate frame 20 can be used.

The device 10 according to the present invention can further comprise one or more optional structures. For example, a ruler 160 can be printed, etched, or injection molded on one or both sides of the front 60 of the elongate frame 20. The ruler 160 can be used to measure the top surface of the object to be hung to find its center point. The ruler 160 can also be used for general measuring to assist in locating the picture on the wall.

The device 10 can further optionally comprise a liquid level 180. Preferably, the liquid level 180 is removably attached to the device 10. In the illustrated embodiment, the liquid level 180 snaps into and is frictionally held to the device 10 by a pair of grips 190 formed in the reinforcing ribs 40. Preferably, the liquid level 180 is mounted to the device 10 such that it is perpendicular to the longitudinal axis of the slot 50. Thus, the liquid level 180 can assist a user in locating the appropriate position where the object will be hung on the wall. Once the object is hung on the wall, the liquid level 180 can be removed from the device 10 and placed on the top surface of the object to assist in leveling the object on the wall. The liquid level 180 preferably has squared ends 200 that can rest on the top surface of the object to be hung.

FIG. 6 is an exploded perspective view of the device 10 show in FIGS. 1–5. The device 10 is assembled by press fitting the pin 110 into a hole in the carriage 90. Once the pin 110 has been press fit into the carriage 90, the carriage 90 can be placed into the channel 70 on the rear surface 80 of the elongate frame 20.

In a preferred embodiment, the pin 110 terminates on a second end in a portion 260 that passes through the carriage 90 and extends in a direction toward the back surface of the object when the frame 20 is positioned adjacent thereto. Preferably, the portion 260 has a smaller diameter than the remainder of the pin 110, which assists in properly locating the depth of the pin 110 passing through the carriage 90. When the object to be hung incorporates an attached toothed metal hanger or other similar support structure (e.g., a tab or a cavity), the toothed metal hanger or other similar support structure can be hung from the portion 260 of the pin 110 passing through the carriage 90 an extending in the direction of the back surface of the object.

In the illustrated embodiment, an 8/32 threaded hex nut 210 is placed into a nut pocket 220 (shown in FIG. 2) on the rear face 230 of the carriage 90. The nut 210 holds the knob 100 to the carriage 90. It will be appreciated that the size of the nut is not per se critical. In the preferred embodiment of the invention, the knob 100 comprises an 8/32 by ½ inch threaded cap screw 240 that is press fit into a plastic injection molded knob handle 250. The threaded end of cap screw 240 passes through the slot 50 and engages the nut 210.

FIG. 6 also shows the liquid level 180 removed from the device 10. This view also more clearly depicts the grips 190 into which the liquid level 180 can be snap fit. In the embodiment of the invention illustrated in FIG. 6, the elongate frame 20, ledge 30, and reinforcing ribs 40 are integrally formed of ABS by injection molding. The carriage 90 is formed of acetal by injection molding. And, the pin 110 and stylus 115 is formed of aluminum.

Figure 7:
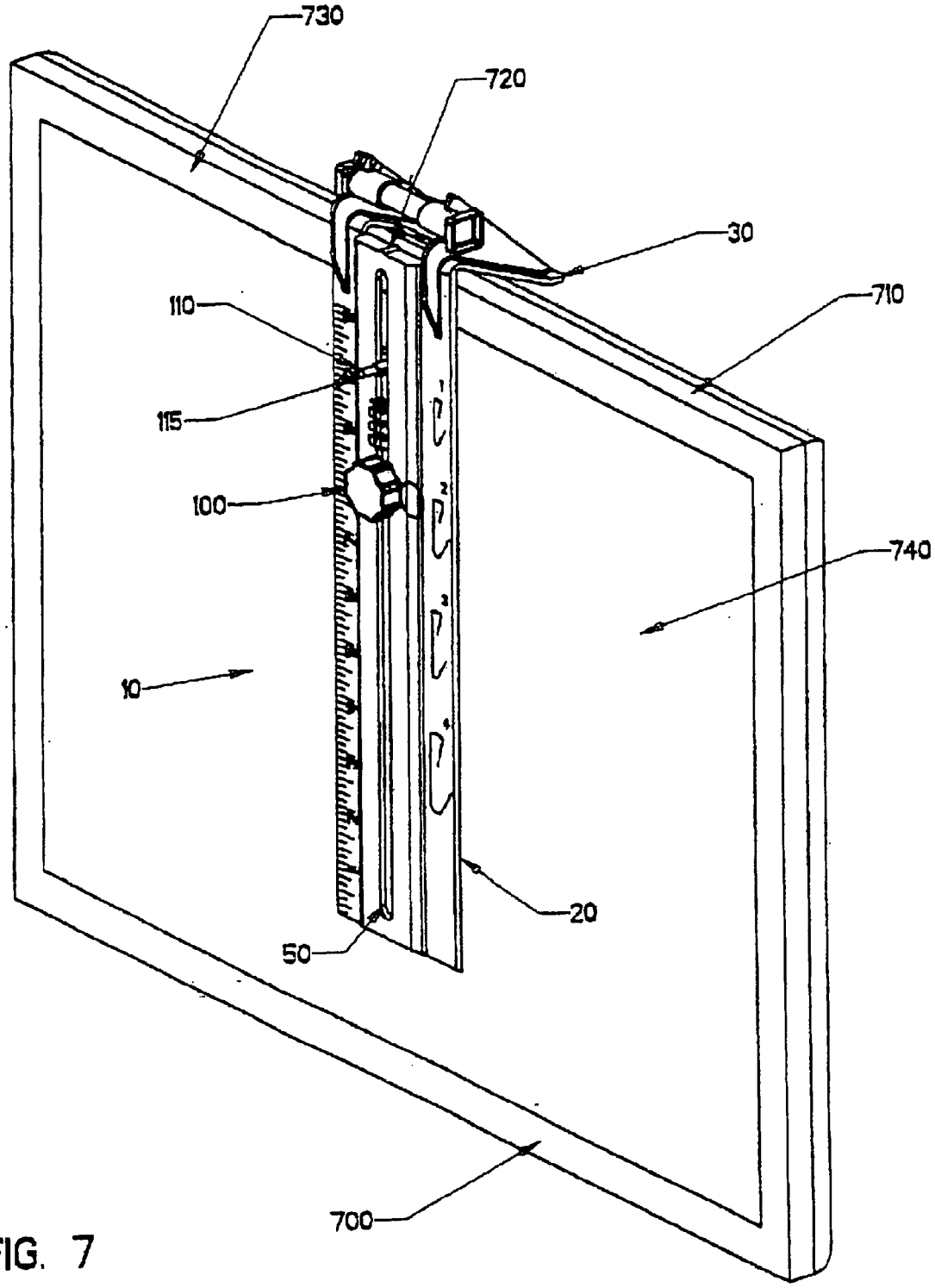
FIG. 7 is a perspective view showing the device shown in FIG. 1 attached to a picture frame having a hanging cord.

FIG. 7 shows a device 10 according to the invention attached to the rear of an object 700 to be hung on a wall, namely a picture frame. To use the device 10, a user first preferably measures the length of the top surface 710 of the object to be hung on the wall using the ruler 160 in order to determine its mid point 720. Once the mid point 720 of the top surface 710 of the object 700 has been located, the device 10 is positioned such that the rear face 80 of the elongate frame 20 is adjacent to the back surface 730 of the object 700 and the ledge 30 is in contact with the top surface 710 of the object 700. Preferably, the device 10 is aligned such that the mid point 720 of the top surface 710 of the object 700 bisects the longitudinal axis of the slot 50. The peak 170 (shown in FIGS. 3 and 6) can be used to properly aligning the device 10 in this manner.

If a fastener 800 such as is depicted in FIG. 8 is to be used to hang the object 700 on a wall, the fastener 800 is matched to one of the silhouettes 130 on the elongate frame 20. Once the proper silhouette 130 is identified, the hanging wire 740 attached to the object 700 to be hung is placed on the hook 120 corresponding to the number 140 of the silhouette 130. If a nail or other simple fastener is to be used to hang the object 700 on the wall, the hanging wire 740 attached to the object 700 is simply hung from the pin 110.

Next, the user slides the carriage 90 upwards along the slot 50 in the direction of the ledge 30 until the hanging wire 740 is taught. The knob 100 can be used as a handle to move the carriage 90 during this operation. Then, the knob 100 is rotated clockwise to draw the carriage 90 against the elongate frame 20 to temporarily hold the carriage 90 in a fixed relationship relative to the elongate frame 20. When the hanging wire 740 is tensioned in this manner, the device 10 is essentially locked to the object 700.

Next, the user identifies the exact location on the wall where the object 700 is to be hung. Once the user has determined the location on the wall where the object 700 is to be hung, the user applies light pressure to the object 700 in the direction of the wall. This causes the stylus 115 to create a small mark or indentation on the wall identifying the point where the fastener should be installed.

The device 10 is then removed from the object 700 by turning the knob 100 in a counter-clockwise direction and sliding the carriage 90 along the slot 50 in a direction away from the ledge 30. The releases the tension on the hanging wire 740, which can easily be removed from the hook 120.

If a fastener 800 such as is depicted in FIG. 8 is to be used, the nail 830 is inserted into the fastener 800 and then driven into the wall through the mark. If only a nail or other simple fastener is to be used, the nail or other simple fastener is driven directly through the indentation or mark on the wall.

The object 700 is then hung on the fastener 800, nail, or other simple fastening device using the hanging wire 740 attached to the object 700. The object 700 will hang in the exact location intended by the user. If necessary, the liquid level 180 can be removed from the device 10 and placed on the top surface 710 of the object 700 to ensure level orientation.

It will be appreciated that the device 10 according to the invention can also be used with an object 700 that uses a toothed metal hangers affixed to the object instead of a hanging wire 740. In such circumstances, the device 10 is positioned against the object 700 as previously described and as shown in FIG. 7. The carriage 90 is moved along the slot 50 in the direction of the ledge 30 until the portion 260 of the pin 110 passing through the carriage 90 and extending in a direction toward the back surface of the object fits into the desired tooth of the metal hanger. The knob 100 is then used to temporarily hold the carriage 90 in a fixed relationship relative to the frame 20. With the device 10 securely to the object 700 in this manner, the object can be positioned by the user in the desired location on the wall, and a mark can be made using the stylus 115 indicating the point where the fastener should be installed as explained above.

The device according to the present invention presents many advantages over the prior art. The device accounts for the difference between the point at which a fastener enters a wall and the point at which a hanging wire makes contact with the fastener. It is adjustable, and can quickly accommodate fasteners of various shapes and sizes. The device can be used on objects having differing geometries and configurations, and can be used to properly hang objects that have hanging wires, slots, or toothed metal hangers. The device is lightweight, compact, and does not require special tools to use. Two or more devices according to the invention can be used at the same time, which is advantageous when hanging large heavy objects on walls.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A device for use in marking a point on a wall where a fastener should be installed in order to hang an object at a desired location on the wall, said device comprising:

an elongate frame having a rear surface and an elongate slot, the rear surface of the frame adapted to be positioned adjacent to a back surface of the object;

a ledge projecting from the frame, the ledge adapted to be positioned in contact with a top surface of the object;

a carriage supported by and contacting the rear surface of the frame, the carriage adapted for reciprocating movement along the slot;

a channel formed on the rear surface of the elongate frame that defines the reciprocating movement of the carriage along the slot;

a pin carried by the carriage, the pin terminating on a first end in a stylus that extends in a direction away from the back surface of the object when the rear surface of the frame is positioned adjacent thereto;

a plurality of hooks carried by the carriage, the hooks being disposed at predetermined distances below the pin; and means for temporarily holding the carriage in a fixed position relative to the frame.

2. The device according to claim 1 wherein said means for temporarily holding the carriage in a fixed position relative to the frame comprises a knob that holds a threaded bolt that extends through said elongate slot and engages a nut on an opposite side of said carriage.

3. The device according to claim 1 wherein said elongate frame is formed of a polymeric material.

4. The device according to claim 3 wherein said polymeric material comprises acrylonitrile-butadiene-styrene.

5. The device according to claim 1 wherein said elongate frame and said ledge are integrally formed.

6. The device according to claim 5 further comprising a pair of reinforcing ribs.

7. The device according to claim 1 wherein said carriage is formed from a polymeric material.

8. The device according to claim 7 wherein said polymeric material comprises acetal.

9. The device according to claim 1 wherein said pin is formed from a material selected from the group consisting of metal, plastic, ceramic, and rigid plastic.

10. The device according to claim 9 wherein said pin terminates on a second end in a portion that passes through the carriage and extends in a direction toward the back surface of the object when the frame is positioned adjacent thereto.

11. The device according to claim 1 wherein said stylus comprises a transfer marking instrument selected from the group consisting of an ink pen and a pencil.

12. The device according to claim 1 wherein said hooks are cut into said carriage.

13. The device according to claim 1 further comprising indicia disposed on said elongate frame for assisting a user in determining the proper hook from which to hang the object.

14. The device according to claim 1 further comprising a liquid level removably attached to an upper surface of said ledge.

15. The device according to claim 1 wherein said elongate frame further comprises a peak or groove for locating the longitudinal axis of the elongate slot.

16. A device for use in marking a point on a wall where a fastener should be installed in order to hang an object at a desired location on the wall, said device comprising:

an elongate frame having an elongate slot, the frame adapted to be positioned adjacent to a back surface of the object;

a ledge projecting from the frame, the ledge adapted to be positioned in contact with a top surface of the object;

a carriage supported by the frame adapted for reciprocating movement along the slot;

a pin carried by the carriage, the pin terminating on a first end in a stylus that extends in a direction away from the back surface of the object when the frame is positioned adjacent thereto;

a plurality of hooks carried by the carriage, the hooks being disposed at predetermined distances below the pin;

means for temporarily holding the carriage in a fixed position relative to the frame; and Indicia disposed on said elongate frame for assisting a user in determining the proper hook from which to hang the object, wherein said indicia comprises silhouettes of picture hanger fasteners of different sizes.

17. A device for use in marking a point on a wall where a fastener should be installed in order to hang an object at a desired location on the wall, said device comprising:

an elongate frame having a rear surface and an elongate slot, the rear surface of the frame adapted to be positioned adjacent to a back surface of the object;

a ledge projecting from the frame, the ledge adapted to be positioned in contact with a top surface of the object, said elongate frame and ledge being integrally formed of a polymeric material;

a carriage supported by and contacting the rear surface of the frame, the carriage adapted for reciprocating movement along the slot, said carriage being formed of a polymeric material;

a channel formed on the rear surface of the elongate frame that defines the reciprocating movement of the carriage along the slot;

a liquid level removably attached to an upper surface of the ledge;

a pin carried by the carriage, the pin terminating on a first end in a stylus that extends in a direction away from the back surface of the object when the rear surface of the frame is positioned adjacent thereto;

a plurality of hooks carried by the carriage, the hooks being disposed at predetermined distances below the stylus; and a threaded knob that engages a threaded post extending from the carriage through the elongate slot to temporarily hold the carriage in a fixed position relative to the frame.

18. The device according to claim 17 wherein said pin terminates on a second end in a portion that passes through the carriage and extends in a direction toward the back surface of the object when the frame is positioned adjacent thereto.

* * * * *